United States Patent [19]

Veenman

[11] 3,971,472

[45] July 27, 1976

[54] CARTON WITH CLAMPING STRIP

[75] Inventor: Jan Aalbert Veenman, Eindhoven, Netherlands

[73] Assignee: U.S. Philips Corporation, New York, N.Y.

[22] Filed: Feb. 27, 1975

[21] Appl. No.: 553,534

[30] Foreign Application Priority Data

Mar. 4, 1974 Netherlands ..... 7402869

[52] U.S. Cl. ..... 206/521; 229/14 C; 229/40

[51] Int. Cl.[2] ..... B65D 81/00; B65D 85/30

[58] Field of Search ..... 206/521, 523, 449, 491, 206/454, 152, 424, 45.31, 45.14, 45.16; 229/40, 15, 42, 87 R, 14 C, 30, 31, 32

[56] References Cited

UNITED STATES PATENTS

| | | | |
|---|---|---|---|
| 2,005,967 | 6/1935 | Berdan | 206/454 |
| 2,144,071 | 1/1939 | Loth | 229/87 R |
| 2,222,211 | 11/1940 | Arneson | 229/52 BC |
| 2,501,609 | 3/1950 | Midouhas | 206/449 |
| 3,029,999 | 4/1962 | DePaul | 229/40 |
| 3,229,892 | 1/1966 | Weiss | 206/152 |
| 3,722,783 | 3/1973 | Rous | 229/40 |

*Primary Examiner*—William T. Dixson, Jr.
*Attorney, Agent, or Firm*—Frank R. Trifari; David R. Treacy

[57] ABSTRACT

A carton formed from a folded sheet of corrugated cardboard having a bottom plate and upright side walls. At least one strip inside the package is cut loose from the material of the bottom plate over a part of its circumference and is folded along its base, the base of the strip extending between adjacent side walls and the edges of the strip adjoining the base bearing against the side walls.

3 Claims, 2 Drawing Figures

CARTON WITH CLAMPING STRIP

BACKGROUND OF THE INVENTION

The invention relates to a box-like container which comprises a bottom plate and upright side walls connected to the edges thereof, and at least one strip inside the container cut loose from the material of the bottom plate over a part of its circumference, said strip comprising a base along which said strip is folded out of the plane of the bottom plate. Such cartons are well known.

In one typical known carton the strip has been cut loose partly from the material of the base plate and partly from the material of one of the upright side walls. When said side wall is folded, the strip is pleated in such manner that the part of the strip cut from the base plate extends parallel to the plane of the side wall, while the part of the strip cut from the side wall extends parallel to the plane of the base plate. The strip thus folded inwards forms a good protection for a side of an article to be packaged.

SUMMARY OF THE INVENTION

It is the object of the invention to provide a carton which offers good protection to that part of an article to be packaged which is present in a corner formed by the bottom plate and two adjoining side walls of the package.

For that purpose, in a carton according to the invention, the base of the strip extends between two adjacent side walls, the edges of the strip adjoining the base each bearing against one of these side walls. Thus the strip is cut from the material of the bottom plate (and possibly partly from the material of the side walls) near a corner of the package. Since the edges adjoining the base of the strip each bear against one of the upright side walls of the package, a resilient support for an article to be packaged is formed.

In a preferred embodiment of the invention the plane of the strip extends inwardly from the base and encloses an angle which is smaller than 90° but larger than 45° with the plane of the bottom plate. As a result of this the resistance against deformation of the strip is increased.

In a further preferred embodiment of the invention the strip has a trapezoidal shape, the base forming one of the parallel sides of the trapezoid. This shape of the strip enables the plane of the strip to enclose an angle with the plane of the bottom plate which is smaller than 90°, when the planes of the side walls are perpendicular to the plane of the bottom plate.

In still another preferred embodiment of the invention the strip comprises an aperture which adjoins the base of the strip, a corner portion of an article to be packaged fitting in said aperture and being clamped there. Such an aperture is of particular advantage when the article to be packaged should be locked not only in directions parallel to the plane of the bottom plate but also in the direction at right angles thereto. This is the case when the article to be packaged has vulnerable parts on its side remote from the bottom plate of the package. The aperture in question in the strip may have been formed by cutting out a lug which extends from the base in the plane of the bottom plate and forms a protection for the corner portion of the article projecting through the aperture.

The carton according to the invention is preferably formed from a sheet of corrugated cardboard which has been folded several times.

The invention will hereinafter be described in greater detail with reference to the drawing which shows an embodiment of the package according to the improvement.

Figure 1:
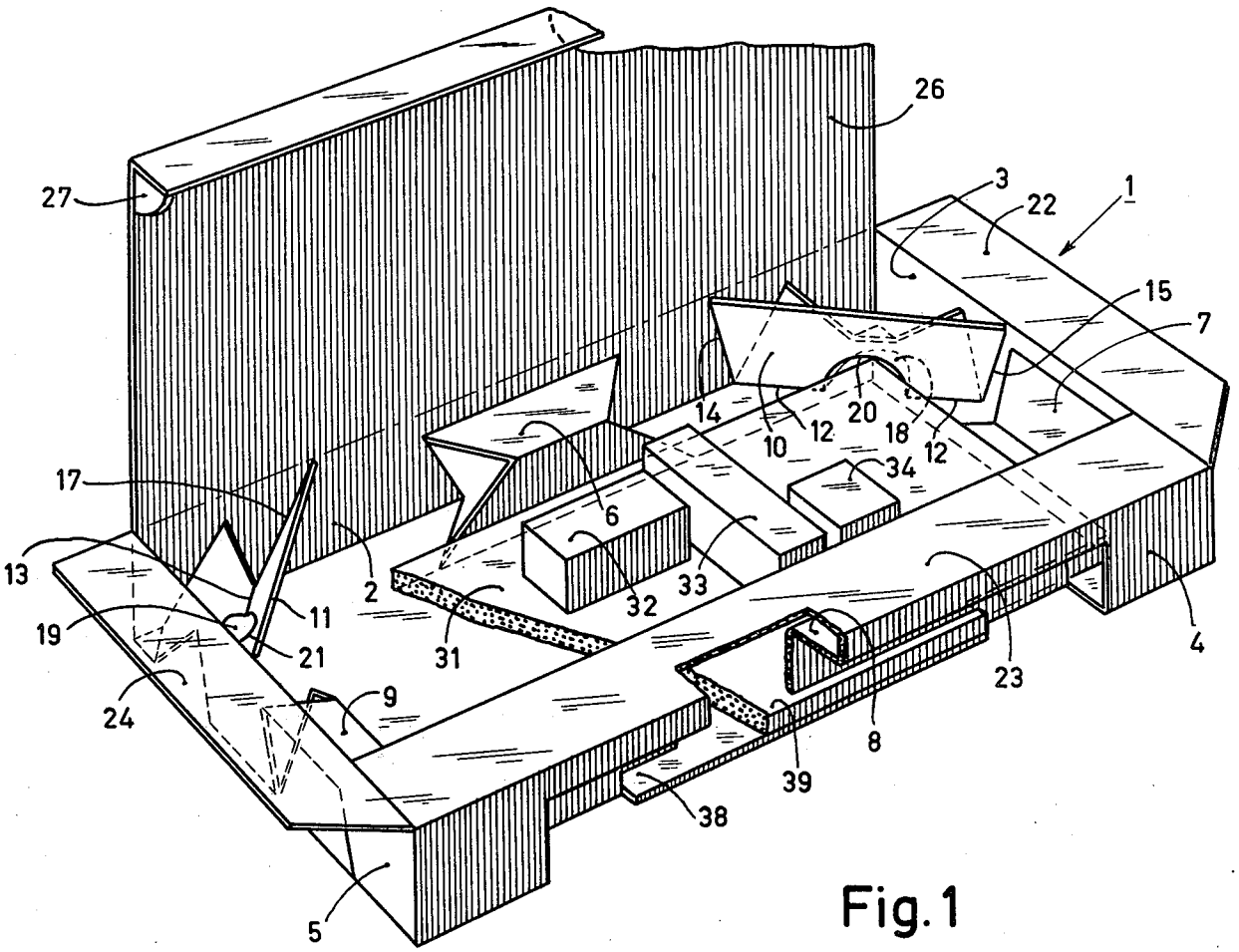
FIG. 1 is a perspective view of a carton according to the invention, containing an article.

The bottom plate of a carton cut from one sheet of corrugated cardboard is denoted in both figures by reference numeral 1. Said bottom plate has a rectangular shape and upright side walls 2, 3, 4 and 5 connected at the edges thereof. Strips 6, 7, 8 and 9 are of a well-known type, cut loose from the material of the bottom plate and of each of the side walls over part of their circumference. Upon folding the carton, these strips are pleated inwards so that the parts of the strips cut from the side walls extend parallel to the plane of the bottom plate and the parts of the strips cut from the material of the bottom plate extend parallel to the planes of the side walls. Such cartons provide good protection to the sides of an article to be packaged.

The carton according to the present improvement comprises two strips which are denoted by 10 and 11. The strips 10 and 11 are cut loose over a part of their circumference from the material of the bottom plate 1 and in the embodiment shown also from a part of the side walls. The strips 10 and 11 are connected to the bottom plate by means of bases 12 and 13, respectively. In the folded condition of the carton the edges 14, 15, 16 and 17 of the strips adjoining the bases bear against the side walls 2, 3, 5 and 2, respectively.

In this embodiment each strip has a trapezoidal shape, the base of each strip forming one of the parallel sides of the trapezoid. As a result in the folded condition of the carton the plane of each strip encloses an angle with the plane of the bottom plate which in this embodiment is approximately 75°. It has been found that this oblique position of the strips contributes to the rigidity of the strips.

Lugs 18 and 19 are cut loose from the strips 10 and 11 so that the apertures 20 and 21 in the strips are formed upon folding. In these apertures the corner portions of an article to be packed can be inserted. In this case said corner portions are locked not only in directions parallel to the plane of the bottom plate but also in the direction at right angles thereto. The lugs 18 and 19 extend in the plane of the bottom plate 1 and constitute an extra protection for the corner portions.

In the embodiment of the package shown in FIG. 1 the side walls 2, 3, 4 and 5 extend at right angles to the plane of the bottom plate. Of course, however, it is also possible for the side walls to assume an inwardly bent position. In that case the strips 10 and 11 may also assume an oblique position relative to the plane of the bottom plate, even when the strips have a shape differing from a trapezoidal shape, for example, a rectangular shape.

The upright side walls 3, 4 and 5 of the carton furthermore comprise strips 22, 23 and 24, respectively, which can be folded inwards. Side wall 4 comprises inserts 25 on either side. The box can be closed with the cover 26 connected to the side wall 2, the free end of which also comprises two inserts 27. The broken lines denoted in FIG. 2 by 28 represent folding lines. At the area of said folding lines, the corrugated cardboard has been weakened by grooves so as to facilitate the folding of the sheet. The incisions in the material are denoted by 29, which incisions enable bending the strips out of the plane of the sheet.

In the above-described embodiment of the invention, the strips 10 and 11 are cut from the material of the bottom plate and of the adjacent side walls. However, it is also possible that the strips are cut loose only from the material of the bottom plate. In both cases it is advantageous when the strips 10 and 11 have such dimensions that the free edges of the strips bear against the cover 26 of the box. It has been found in practice that such a package presents good protection against impacts for very vulnerable articles. Such an article may be, for example, a vulnerable panel 31 which has printed wiring and components 32, 33 and 34. Said panel is enclosed between the folded strips 6, 7, 8 and 9 with its side edges and is locked at its corners in the vertical direction in the apertures 19 and 20 of the strips 10 and 11. This embodiment shows only two strips 10 and 11 in adjacent corner portions of the package. It will be obvious that the place of said strips may also be chosen differently, for example, in oppositely located corner portions of the carton.

Figure 2:
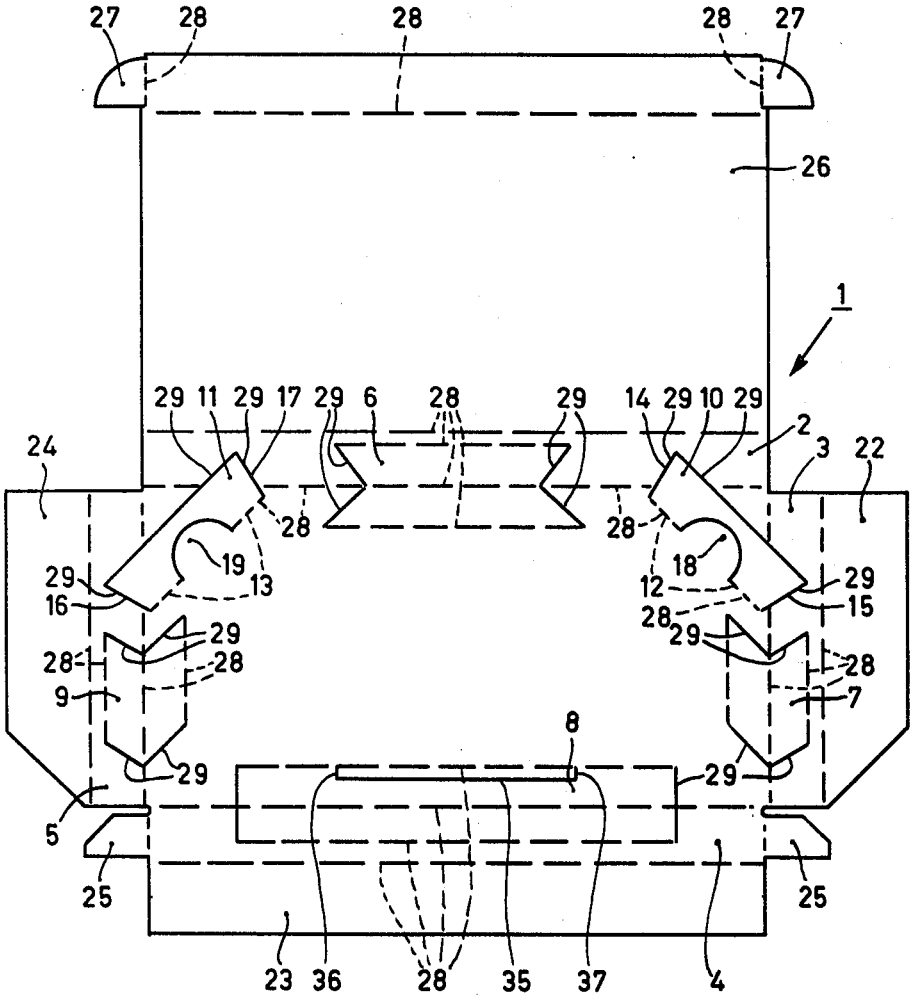
FIG. 2 shows the lay-out in a flat plane of the sheet of corrugated cardboard from which the package shown in FIG. 1 has been obtained by a folding operation.

The packaging of the article shown is carried out as follows. The article is positioned on the sheet laid out in one plane (FIG. 2). The side walls 2, 3, 4 and 5 are then formed, the strips 6, 7, 8 and 9 assuming the positions shown in FIG. 1 and enclosing the article at its circumference. Simultaneously the strips 10 and 11 are folded out of the plane of the plate and moved in the position shown in FIG. 1, thus locking the article in two corner points of the package in the direction of height. In this example the strip 8 has extra incisions 35, 36 and 37, so that in a position bent out of the plane of the sheet it releases a slot 38 in which the panel 31 can be locked in the direction of height with a projecting edge portion 39. The strips 22, 23 and 24 are finally folded and the part of the sheet serving as cover 26 of the package is folded and locked.

If desired, the package described may serve as a final product in which the contents remain accessible through the various apertures formed upon folding. However, it is preferably accommodated, together with, for example, 9 other packages, in a cardboard box surrounding the assembly. In this case the carton according to the invention serves as an auxiliary box for vulnerable panels which can withstand shocks or impacts, while the enveloping box serves as a final package.

What is claimed is:

1. A carton comprising a planar bottom plate and side walls formed from a sheet of material folded at edges of said bottom plate, wherein said carton further comprises an oblique corner strip formed by a portion of said sheet of material, said corner strip comprising a base and edges, said strip being cut from said sheet along said edges and folded along said base out of the plane of the bottom plate, said base extending between two adjacent side walls and two edges, each of said two edges bearing against a respective one of said two adjacent side walls, said strip extending inwardly and upwardly from the base so as to enclose an angle greater than 45° and less than 90° with respect to the plane of the bottom plate.

2. A carton as claimed in claim 1, wherein said side walls are perpendicular to said bottom plate and said strip is trapezoidal in shape, the base forming one of the parallel sides of the trapezoid.

3. A carton as claimed in claim 1, wherein said strip comprises an aperture adjoining the base, adapted for clamping a corner portion of an article which fits in said aperture.

* * * * *